US006779608B2

(12) United States Patent
Grubb et al.

(10) Patent No.: US 6,779,608 B2
(45) Date of Patent: Aug. 24, 2004

(54) SURFACE PUMP ASSEMBLY

(75) Inventors: William A. Grubb, Houston, TX (US); Robert DeLong, Austin, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 251 days.

(21) Appl. No.: 09/826,409

(22) Filed: Apr. 4, 2001

(65) Prior Publication Data

US 2001/0040032 A1 Nov. 15, 2001

Related U.S. Application Data

(60) Provisional application No. 60/194,995, filed on Apr. 5, 2000.

(51) Int. Cl.[7] ..... E21B 21/00; F04B 39/12

(52) U.S. Cl. ..... 166/379; 166/90.1; 417/53; 417/252; 417/435

(58) Field of Search ..... 166/68.5, 68, 90.1, 166/379; 417/435, 252, 53

(56) References Cited

U.S. PATENT DOCUMENTS

| | | | | |
|---|---|---|---|---|
| 1,410,228 A | * | 3/1922 | Stuck | 417/77 |
| 2,046,769 A | * | 7/1936 | Coberly | 166/265 |
| 2,119,737 A | * | 6/1938 | Coberly | 166/52 |
| 3,234,879 A | * | 2/1966 | Brown | 166/68.5 |
| 3,432,992 A | | 3/1969 | Moore | 55/51 |
| 4,662,831 A | | 5/1987 | Bennett | 417/430 |
| 4,696,343 A | | 9/1987 | Anderson et al. | 166/164 |
| 5,203,682 A | * | 4/1993 | Inklebarger | 417/435 |
| 5,220,962 A | | 6/1993 | Muller et al. | 166/369 |
| 5,269,180 A | | 12/1993 | Dave et al. | 73/152 |
| 5,517,854 A | | 5/1996 | Plumb et al. | 73/151 |
| 5,626,467 A | | 5/1997 | Cantley | 417/312 |
| 5,734,209 A | | 3/1998 | Hallidy | 310/12 |
| 5,799,834 A | | 9/1998 | Small et al. | 222/148 |
| 5,813,469 A | | 9/1998 | Bowlin | 166/369 |
| 5,957,656 A | | 9/1999 | De Long | 415/104 |
| 6,079,491 A | | 6/2000 | Stuebinger et al. | 166/266 |

OTHER PUBLICATIONS

PCT International Search Report from PCT/GB 01/02789, Dated Oct. 29, 2001.

U.S. patent application Ser. No. 09/608,077, (Grubb et al.), filed Jun. 30, 2000.

* cited by examiner

*Primary Examiner*—Hoang Dang
(74) *Attorney, Agent, or Firm*—Moser, Patterson & Sheridan

(57) ABSTRACT

A surface pump assembly having a pressure vessel containing a submersible pump and an industrial motor located at least partially external to the pressure vessel having a shaft or seal thrust chamber extending at least partially into the pressure vessel to connect to pump. The pressure vessel has an inlet connected to a fluid source and one or more bleed off or pressure relief valves. The pump has an intake to receive the fluid and a discharge connected to a discharge conduit.

15 Claims, 2 Drawing Sheets

SURFACE PUMP ASSEMBLY

This application claims priority to Provisional U.S. patent application Ser. No. 60/194,995, entitled 'Pressure Boost Pump' filed on Apr. 5, 2000, which is hereby incorporated by reference in its entirety, which is not inconsistent with the disclosure herein.

BACKGROUND OF THE INVENTION

1. Field of the Invention

The present invention generally relates to pumps for transferring and/or injecting fluids into a well and/or pipeline. More particularly, the invention relates to a surface-located pumping apparatus that reduces environmental hazards associated with pumps.

2. Background of the Related Art

In oil field applications fluid, like water or oil, is often pressurized and moved either between surface locations or is moved from a surface location to at least one downhole location. For example, there are instances where collected oil must be transported to a remotely located processing facility. In other instances, water is pumped down an injection well for disposal or for maintaining or increasing reservoir pressure in enhanced recovery operations or to encourage the flow of oil in underground formations to another well for recovery. In still other instances, pressurized water is injected into a wellbore to become mixed with oil and bring the oil to the surface of the well where it is separated from the water and collected.

Pumping oil out of a well that does not have adequate natural formation pressure is conventionally done through the use of an electric submersible pump located in the wellbore. The pumps operate at the end of a tubular string and include a pump and an electric motor along with a source of electrical power supplied from the surface to operate the electric motor. Because they operate in fluid at the bottom of a wellbore, electric submersible pumps are necessarily more expensive than conventional surface-mounted pumps. Additionally, repair or replacement of a submersible pump requires the removal of the entire pump assembly, which requires equipment, personnel, time and results in down time for the well.

In order to avoid the expense and problems associates with submersible pumps, jet pumps have been used in wellbores and are operated by surface-mounted equipment. The jet pump operates using the energy provided by fluid pumped under high pressure (power fluid) through them. A nozzle in the jet pump narrows the power fluid stream, draws in well fluid and carries it to the surface. If the power fluid is miscible (i.e., an oil) it will blend with the crude oil. If it is a non-miscible fluid such as water, it will separate easily at the surface. In either case, power fluid is usually separated from the produced liquid and then returned to the high-pressure pump for another trip downhole. Because positive displacement pumps are subject to leakage and because many wells are operated today in environmentally sensitive and remote jurisdictions, like Alaska, other types of pumps have been utilized at the surface of a well to operate jet pumps in a wellbore. In one example, a horizontal pump assembly including a standard industrial motor and an electric submersible pump is used at the surface of the well to operate a jet pump downhole. The advantage of the surface-mounted pump is that the motor is less expensive than a downhole motor and the apparatus can be accessed for repair or replacement without pulling it out of a wellbore.

All surface mounted pumping arrangements are subject to at least some leakage. In some environmentally sensitive areas, the entire apparatus is enclosed in a large container that includes alarms, sensors and kill switches to detect the presence of and to contain leaks.

In order to reduce expense and containment costs related to surface located pumps in sensitive areas, a jacketed pump assembly has been utilized and includes a submersible electric pump assembly that is housed in a pressurized jacket. In this manner, all leaks from the apparatus are contained within the jacket and the jacket is filled with fluid to provide a source of fluid to the pump intake that is located in the jacket.

As one example, a multistage centrifugal pump is mounted at the surface adjacent to the well. The centrifugal pump is of a type that normally would be utilized in a vertical application within a well for pumping fluid from the well. The pump and related assembly are typically mounted in a pressure vessel or jacket and disposed at an incline relative to horizontal. Such a pumping assembly is shown in FIG. 1. The assembly includes a pressure vessel 20 containing an entire submersible pump assembly 23. The submersible pump assembly includes a submersible electric motor 25 and a centrifugal pump 29 having inlet 31. The jacket has an inlet 13 connected to a pump 19 and a fluid tank 21. The pump is connected to a discharge conduit 33. The pump is typically a self contained electric submersible pump which is disposed in the pressure vessel or jacket. The above described assembly is further described in U.S. Pat. No. 5,203,682, entitled "Inclined Pressure Boost Pump", which is incorporated herein by reference in its entirety.

While the forgoing apparatus is effective in providing pressurized fluid from the surface of a well in an environmentally sensitive way, it still suffers form some of the same problems of prior systems. Mainly, the apparatus includes the expensive, submerged electrical motors made for downhole, submerged use. Additionally, because the motors are included in the jacket, the electrical portions of the pump are also exposed to potentially corrosive and damaging fluids.

Therefore, there is a need for a simple surface pump which can be used to inject fluids, such as water, into a well at elevated pressure.

SUMMARY OF THE INVENTION

In one aspect, the invention provides a pump assembly comprising a pressure vessel housing a submersible pump, an industrial motor positioned adjacent the pressure vessel and having a shaft extending into the pressure vessel and connected to the pump. The pressure vessel has an inlet connected to a fluid source. The pump has an intake at one end and a discharge at the other end. A discharge conduit is connected between the pump discharge and a receiving vessel, such as a pipeline, well or tank. The pressure vessel may include a bleed off valve on an upper surface thereof and pressure relief valve. A mounting bracket or support mounts the pump assembly and may support the pressure vessel at an incline relative to horizontal or horizontal.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
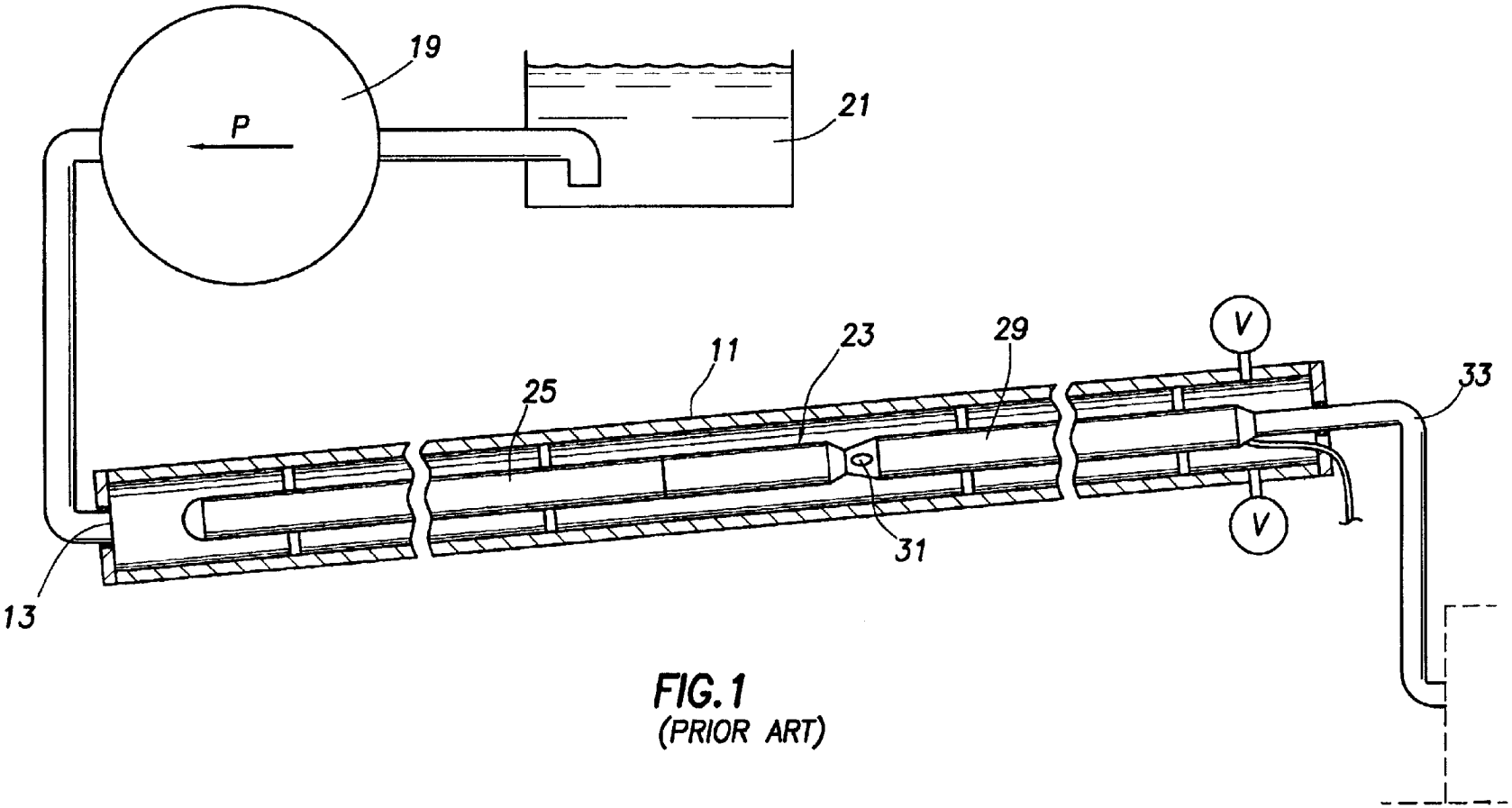
FIG. 1 (PRIOR ART)
FIG. 1 is a schematic view of a prior art pump assembly.
Figure 2:
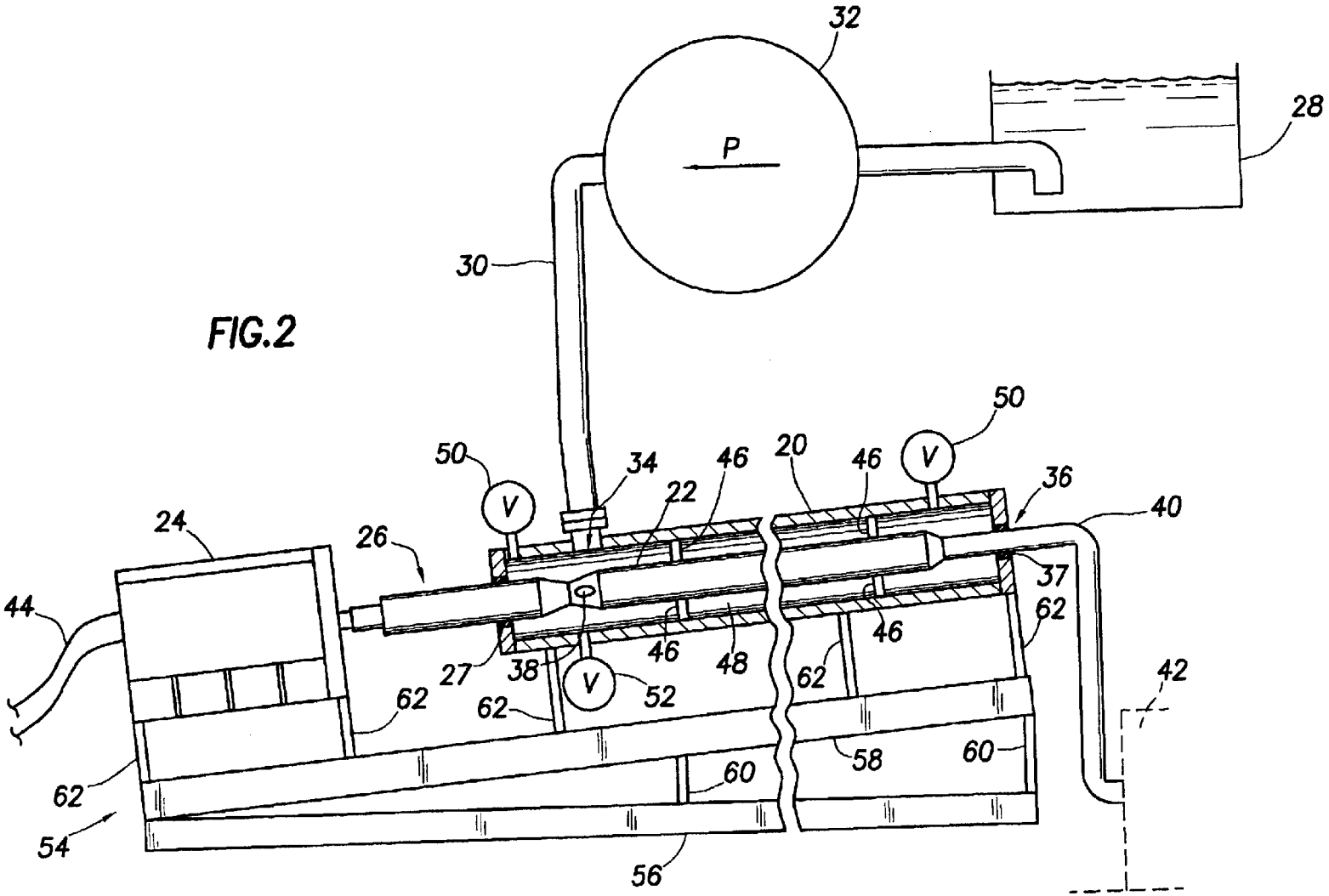
FIG. 2 is a schematic view illustrating a pump assembly of the invention.

FIG. 2 is a schematic cross sectional view of a pump assembly of one embodiment of the invention. The pump assembly generally includes a pressure vessel 20 having a pump 22 housed therein, a motor 24 disposed external to the pressure vessel and having a seal thrust chamber 26 extending at least partially into the pressure vessel, and a fluid source 28 connected to the pressure vessel by a feed line 30 having a feed pump 32 disposed along its length. The pressure vessel can be a long tubular member, such as casing of a type that is used for casing a well, having a typical inner diameter of about six inches, for example.

The pressure vessel 20 is a sealed pressure vessel having an inlet 34 in one end and a discharge end 36 on the opposite end. The feed line 30 connects the feed pump 32 to the inlet 34. The feed pump 32 is of a conventional type, either centrifugal or reciprocating, and has an intake which is connected to the fluid source 28. The fluid source 28 may be, for example, a tank or well containing water.

The submersible pump 22 is mounted inside the pressure vessel 20. The submersible pump assembly can be a conventional type of pump that is normally employed downhole in a well in a vertical application. The submersible pump is driven by a conventional industrial electrical motor 24 mounted adjacent to the pressure vessel 20. An example of suitable motors includes three phase induction motors. The motor 24 has a seal thrust chamber 26 that sealably extends through the pressure vessel 20 and contains thrust bearings. Alternatively, the shaft of the motor may extend into the pressure vessel to connect to the pump. Centrifugal pump 22 has a large number of stages, each stage having a diffuser and a rotating impeller. In another embodiment, the motor is a gas or natural gas powered engine and the invention is not limited to use with a particular surface-mounted driver means.

Centrifugal pump 22 has an intake 38 that is located at its lower end immediately above pressure vessel seal 27 of the pressure vessel. Pump intake 38 is located at the lower end of the pressure vessel adjacent the end wall thereof. The discharge of pump 22 connects to a discharge conduit 40. Discharge conduit 40 extends through the closed discharge end 36 of the pressure vessel and is sealed therewith by seals 37. The discharge fluid flows out the discharge conduit 40 to a receiving vessel, such as a pipeline, well 42 or tank.

A power cable 44 supplies power from an AC power source to the motor 24. The submersible pump 22 mounts within the pressure vessel 20 on a plurality of centralizers 46. Centralizers 46 support the submersible pump 22 so that its longitudinal axis coincides with the longitudinal axis of the pressure vessel 20. The outer diameter of centrifugal pump 22 is less than the inner diameter of the pressure vessel 20 to provide an annular clearance space 48. Fluid from inlet 34 flows in the clearance space 48 and through passages formed in the centralizers 46 to the intake 38 of the pump.

A bleed off valve 50 is located near the discharge end 36 of the pump on the upper side of the pressure vessel 20 at an elevation higher than the inlet 38 to allow any gas contained within the fluid to migrate toward and collect in the pressure vessel adjacent the bleed off valve. This gas can be vented or bled off by opening the bleed off valve 50 periodically. Bleed off valve 50 can be a manual valve connected with a port to communicate the interior of the pressure vessel 20 to the exterior thereof. Alternately, the bleed off valve 50 can be an automatic type valve utilizing a float which triggers the release of gas when the fluid level drops.

A drain valve 52 can also be employed with the pressure vessel 20. Drain valve 52 is set to relieve pressure in the interior of the pressure vessel 20 if the pressure exceeds a selected threshold or drain the pressure vessel. Drain valve 52 can be of a conventional type.

The pressure vessel 20 can be mounted generally horizontal or at an incline of about ten degrees relative to horizontal. The amount of inclination is selected to be sufficient to cause gas at the inlet 34 to migrate toward and collect in the pressure vessel 20 at the discharge end 36.

A mounting bracket or support 54 supports the pressure vessel 20 at the desired inclination. The mounting bracket or support 54 can include a brace 56 mounting an upper brace 58 at an angle thereto via a plurality of legs 60. Another plurality of legs 62 extend from the upper brace 58 and mount the pressure vessel 20 and the motor 24. The legs 60, 62 incrementally increase in height from one end to the other end.

In operation, the feed pump 32 or fluid source will pump fluid from fluid source 28 into the pressure vessel 20. A typical pressure of the fluid into the pressure vessel is about 2,500 PSI. The feed pressure could be as low as 1 PSI or less, and possibly as high as 7,500 PSI, depending upon the strength of pressure vessel 20.

The fluid will flow into the interior of the pressure vessel 20, pressurizing the vessel 20 to a pressure that is approximately the same as the discharge pressure of feed pump 32. Electrical power is supplied to motor 24 and the motor shaft will rotate the seal thrust chamber shaft which in turn rotates the pump shaft contained within centrifugal pump 22. The pump will draw fluid in intake 38 and pump it out the discharge conduit 40 at a higher pressure. Typically, the discharge pressure of pump 22 will be around 3,900 to 4,300 PSI with an intake pressure of 2500 PSI. The discharge pressure could be as high as 6,000 PSI. The water flows out the discharge conduit 40 into a receiving vessel, such as a pipeline, well 42 or tank.

As illustrated and discussed in the forgoing, the invention provides an apparatus for transporting pressurized fluid that utilizes an industrial motor that is located external of the pressurized jacket portion of the apparatus.

In addition to the forging preferred use of the invention, the present apparatus can also be utilized to transport fluid from the surface of the well to some collecting station at a remote location. Additionally, the apparatus can be used in injection wells and can provide pressurized water to a number of different wells at different locations in a field. Also, the apparatus of the present invention could be operated and located at some depth lower than surface to avoid harsh weather conditions, for example.

While foregoing is directed to the preferred embodiment of the present invention, other and further embodiments of the invention may be devised without departing from the basic scope thereof, and the scope thereof is determined by the claims that follow.

What is claimed is:

1. A surface-located pumping apparatus for pumping fluid from a fluid source, comprising:

a pressure vessel having an inlet adapted to be connected to the fluid source;

a submersible pump disposed in the pressure vessel, the pump having an intake disposed in an interior of the pressure vessel and a discharge isolated from the fluid in the interior of the pressure vessel; and an industrial motor located adjacent the pressure vessel and having a shaft or seal thrust chamber extending at least partially into the pressure vessel to connect to the pump.

2. The apparatus according to claim 1 further comprising a discharge conduit mounted to the discharge of the pump, the discharge conduit extending sealingly through the discharge end of the pressure vessel.

3. The apparatus according to claim 1 further comprising a pressure relief valve at an end of the pressure vessel.

4. The apparatus according to claim 1, further comprising a drain valve in the pressure vessel for draining the pressure vessel.

5. The apparatus according to claim 1, further comprising a plurality of centralizers for supporting the pump above a lower wall of the pressure vessel.

6. The apparatus of claim 1, wherein the fluid is pumped into a wellbore.

7. The apparatus of claim 6, wherein the fluid is utilized in the wellbore by a jet pump.

8. The apparatus of claim 1, wherein the fluid is transported to a second location on the surface.

9. The apparatus of claim 1, wherein the fluid is transported to at least two wellbores and utilized therein.

10. The apparatus of claim 1, wherein the fluid is injected into a well formation located adjacent a wellbore.

11. An apparatus for pumping fluid down a well, comprising:

a flow line feed pump having an intake connected to a source of fluid and an outlet for transferring the fluid out the outlet at a selected feed pressure;

a pressure vessel connected to the fluid source by an inlet on one end;

a submersible pump contained within the pressure vessel and connected to a motor located at least partially outside of the pressure vessel and having a shaft or seal thrust chamber sealably extending at least partially into the pressure vessel, the pump having an intake disposed in the pressure vessel and a discharge connected to a discharge conduit sealably extending through the pressure vessel; and a valve disposed at the discharge end of the pressure vessel for bleeding off any accumulation of gases.

12. A surface-located pumping apparatus for pumping fluid from a fluid source, comprising:

a sealed vessel having an inlet adapted to be connected to the fluid source;

a pump disposed in the sealed vessel, the pump having an intake and having a discharge outside the pressure vessel; and a motor located external to the pressure vessel, the motor constructed and arranged to operate the pump and having a shaft extending thereto.

13. The surface-located pumping apparatus of claim 12, wherein the discharge is directly to outside the pressure vessel.

14. A surface-located pumping apparatus for pumping fluid from a fluid source, comprising:

a sealed vessel having an inlet adapted to be connected to the fluid source;

a single pump disposed in the pressure vessel, the pump having an intake disposed in the fluid within the sealed vessel and a discharge isolated from the fluid within the sealed vessel; and a motor located external to the pressure vessel, the motor constructed and arranged to operate the pump and having a shaft extending thereto.

15. A method of pumping a fluid supplied from a source, comprising:

providing a sealed vessel and a pump having an intake disposed in an interior of the vessel;

supplying the fluid from the source to an inlet of the vessel;

operating the pump, thereby drawing the fluid in the vessel to the intake of the pump, the pump having a motor located external to the sealed vessel; and transporting the fluid through a fluid path to a discharge while isolating the fluid in the path from the fluid in the vessel.

* * * * *